US006619407B1

(12) United States Patent
Hawkins et al.

(10) Patent No.: US 6,619,407 B1
(45) Date of Patent: Sep. 16, 2003

(54) AIR-OPERATED HAMMER

(76) Inventors: Charles L. Hawkins, 3097 Anderson Rd., Green Cove Springs, FL (US) 32043; Robert C. Tyer, 5883 Country Rd. 352, Keystone Heights, FL (US) 32656

( * ) Notice: Subject to any disclaimer, the term of this patent is extended or adjusted under 35 U.S.C. 154(b) by 70 days.

(21) Appl. No.: 09/789,145

(22) Filed: Feb. 20, 2001

Related U.S. Application Data

(63) Continuation-in-part of application No. 09/302,692, filed on Apr. 29, 1999, now abandoned.
(60) Provisional application No. 60/083,539, filed on Apr. 29, 1998.

(51) Int. Cl.[7] ..... E02D 7/02
(52) U.S. Cl. ..... 173/13; 173/115; 173/127; 173/206; 173/207
(58) Field of Search ..... 173/1, 13, 115, 173/127, 133, 90, 91, 89, 206, 207; 405/228

(56) References Cited

U.S. PATENT DOCUMENTS 2,613,923 A 10/1952 Cornett
2,933,068 A 4/1960 Johnson et al.
3,838,741 A 10/1974 Pepe
4,086,968 A 5/1978 Wandell
4,106,569 A 8/1978 Edgworth et al.
4,367,800 A 1/1983 Arentsen
4,377,355 A 3/1983 Chelminski
4,523,647 A 6/1985 Last

*Primary Examiner*—Scott A. Smith
(74) *Attorney, Agent, or Firm*—Saliwanchik, Lloyd & Saliwanchik

(57) ABSTRACT

The subject invention pertains to an improved air-operated hammer which can utilize a pressurized air reservoir located near a pressurized air entrance of the hammer. This pressurized air reservoir can continue to receive pressurized air even when the hammerhead is failing and, preferably, can enable pressurized, air to enter the hammer at, a faster rate than the hammer's external compressed-air source can supply. The subject invention can utilize a compressed-air source with a lower flow rate and/or lower pressure in comparison with a typical air-operated hammer, in order to achieve the same hammer performance. Alternatively, the subject invention can utilize an equivalent compressed-air source in comparison with a typical air-operated hammer, in order to achieve superior hammer performance, for example shorter time periods to raise the hammer head leading to move hammer drops per time. The subject invention also related to an automatic control valve system which can be utilized to cycle the subject hammer. The subject valve system can utilize pressurized air, for example from a compressed-air source or a pressurized-air reservoir associated with the subject hammer.

40 Claims, 10 Drawing Sheets

AIR-OPERATED HAMMER

CROSS-REFERENCE TO A RELATED APPLICATION

This application is a C-I-P of the filing date of U.S. application Ser. No. 09/302,692 filed Apr. 29, 1999 now abandoned, which claims priority to U.S. Provisional Application Serial No. 60/083,539 filed Apr. 29, 1998.

BACKGROUND OF THE INVENTION

The subject invention relates to an improved air-operated hammer. The uses for which the subject air-operated hammer find application include, but are not limited to, pilehammers, concrete breakers, forging hammers, and compacting.

Current air-operated hammers typically have an external compressed-air source which supplies pressurized air to the hammer, for example via an air hose. This pressurized air is used to lift the hammer's head such that gravity, and/or additional mechanisms, can drive the hammer head down, for example to drive a piling into the ground. Once the hammer head drops and reaches the object it is intended to contact, the hammer can again begin to accept pressurized air in such a fashion as to lift the hammer head back up.

Accordingly, the expansion of the received pressurized air supplies the work needed to raise the hammer head during the operation of the hammer. The rate at which the hammer head is raised is therefore dependent on the pressure and the rate of flow of the pressurized air into the hammer. In order to raise the hammer faster, an air source with a larger flow rate and/or higher pressure is needed.

Once the hammer head is raised, for example to a predetermined position, the flow of pressurized air into the hammer is typically shutoff by some sort of valve on the hammer in order to allow the hammer head to drop during the down stroke. Accordingly, during the period of time that the hammer head is falling the compressed-air supply is typically not supplying air to the hammer.

The subject invention pertains to an improved air-operated hammer which can utilize a pressurized air reservoir located near a pressurized air entrance of the hammer. This pressurized air reservoir can continue to receive pressurized air even when the hammer head is falling and, preferably, can enable pressurized air to enter the hammer at a faster rate than the hammer's external compressed-air source can supply.

BRIEF SUMMARY OF THE INVENTION

The subject invention pertains to an improved air-operated hammer which can utilize a pressurized air reservoir located near a pressurized air entrance of the hammer. This pressurized air reservoir can continue to receive pressurized air even when the hammer head is falling and, preferably, can enable pressurized air to enter the hammer at a faster rate than the hammer's external compressed-air source can supply.

The subject invention can utilize a compressed-air source with a lower flow rate and/or lower pressure in comparison with a typical air-operated hammer, in order to achieve the same hammer performance. Alternatively, the subject invention can utilize an equivalent compressed-air source in comparison with a typical air-operated hammer, in order to achieve superior hammer performance, for example shorter time periods to raise the hammer head leading to move hammer drops per time.

The subject invention also relates to an automatic control valve system which can be utilized to cycle the subject hammer. The subject valve system can utilize pressurized air, for example from a compressed-air source or a pressurized-air reservoir associated with the subject hammer.

DETAILED DISCLOSURE OF THE INVENTION

The subject invention pertains to an improved air-operated hammer which can utilize a pressurized air reservoir. For example, this pressurized air reservoir can be located near a pressurized air entrance of a cylinder housing a piston for raising the hammer head. This pressurized air reservoir can continue to receive pressurized air from a compressed-air source even when the hammer head is falling. Preferably, the reservoir can enable pressurized air to enter the cylinder of the hammer at a faster rate than the hammer's compressed-air source can supply. The hammer's compressed-air source 40 can be located external to the hammer such that the source delivers air through, for example, a high pressure air hose. Alternatively, the hammer's compressed-air source can reside on the hammer. The subject hammer can be lightweight and, in a specific embodiment, can be mounted on a vehicle.

The subject invention can utilize a compressed-air source with a lower flow rate and/or lower pressure in comparison with a typical air-operated hammer, in order to achieve the same hammer performance. Alternatively, the subject invention can utilize an equivalent compressed-air source in comparison with a typical air-operated hammer, in order to achieve superior hammer performance, for example shorter time periods to raise the hammer head, leading to more hammer cycles per time. In addition, other fluid sources can be utilized in accordance with the subject invention, for example steam and various gases.

The subject invention also relates to an automatic control valve system which can be utilized to cycle the subject hammer. The subject valve system can utilize pressurized air, for example from a compressed-air source or a pressurized-air reservoir associated, with the subject hammer.

Figure 2A:
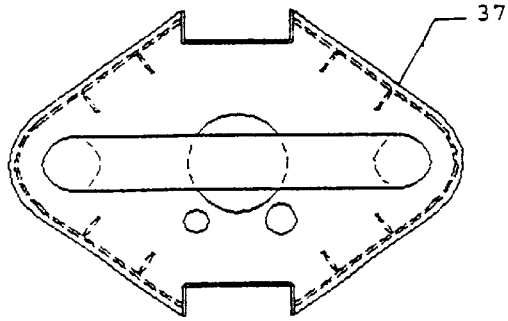
FIGS. 2A and 2B show a top view of the air-operator hammer of FIGS. 1A and 1B, respectively.
Figure 1A:
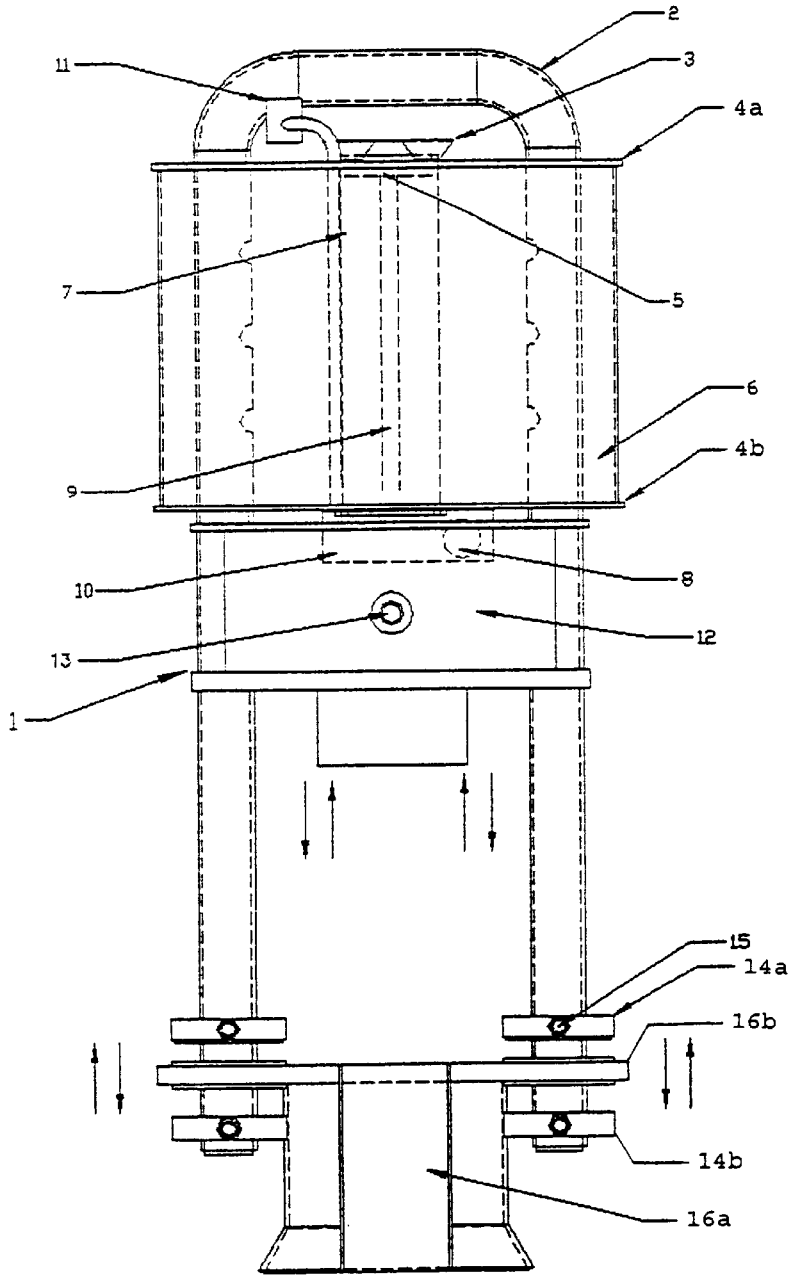
FIG. 1A shows a front view of a specific embodiment of an air-operated hammer, with the hammer head in the up position, in accordance with the subject invention.
Figure 2B:
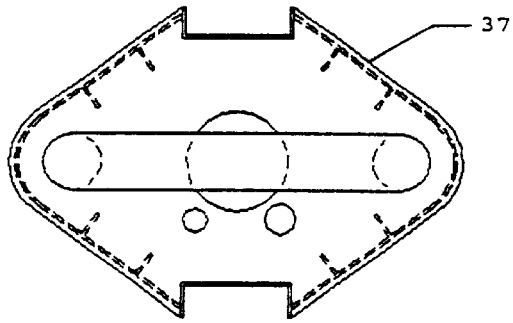
Figure 1B:
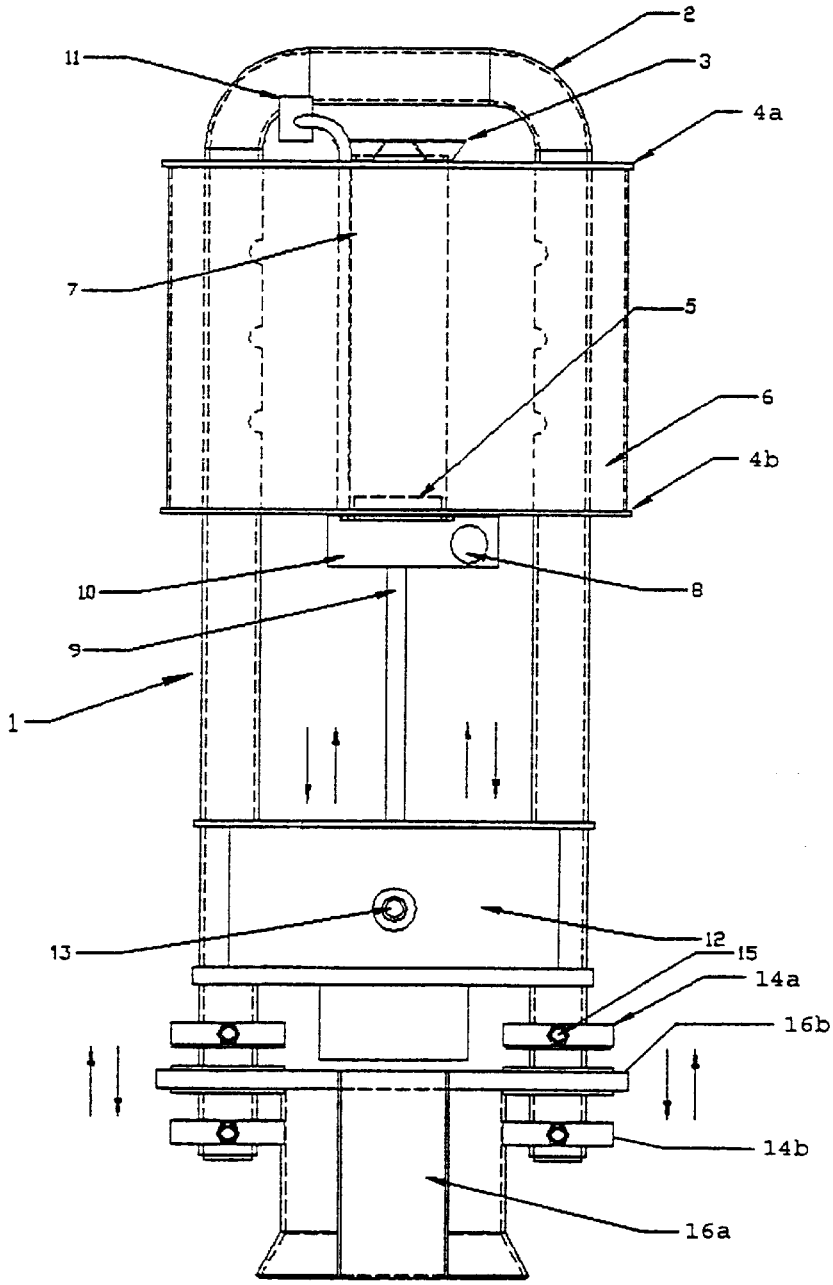
FIG. 1B shows a front view of a specific embodiment of an air-operated hammer, with the hammer head in the down position, in accordance with the subject invention.
Figure 3A:
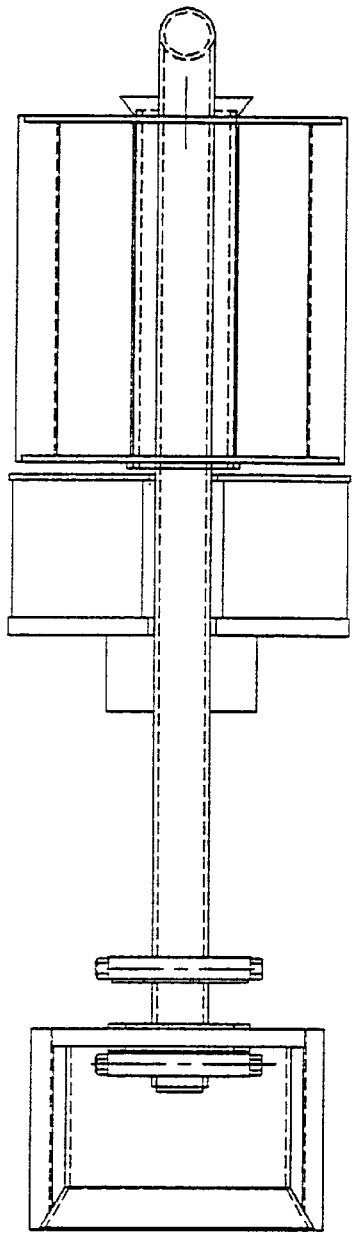
FIGS. 3A and 3B show side views of the air-operator hammer of FIGS. 1A and 1B, in the hammerhead up and down positions, respectively.
Figure 4A:
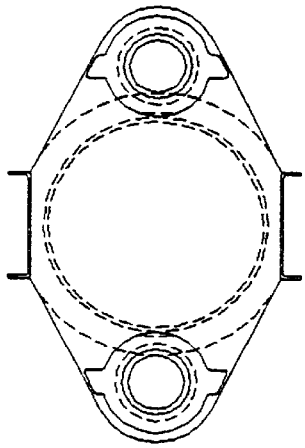
FIGS. 4A and 4B show a bottom view of the anvil skirt and anvil of the air-operated hammer of FIGS. 3A and 3B, respectively.
Figure 3B:
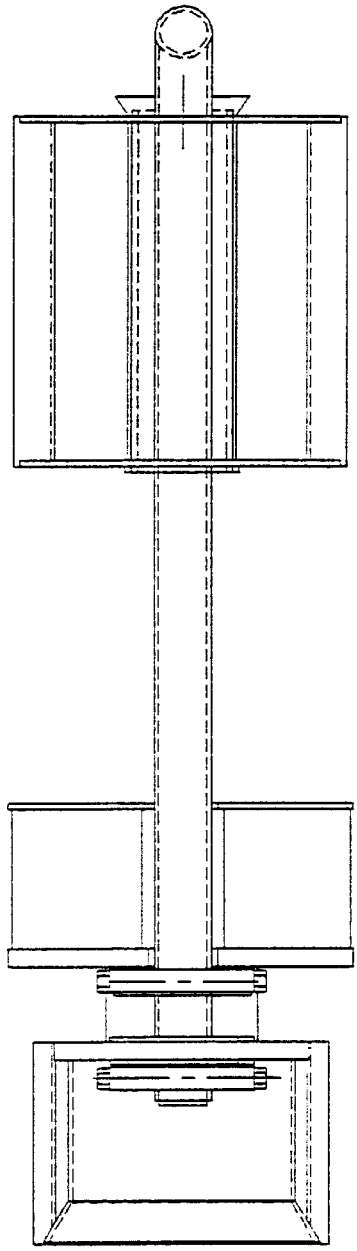
Figure 4B:
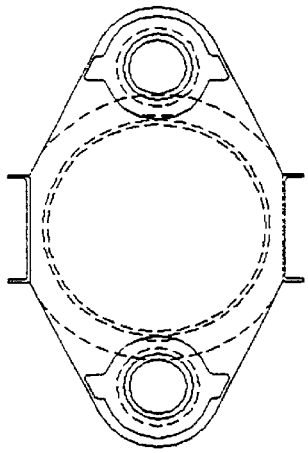

Referring to FIG. 1A and 1B, a front view of a specific embodiment of an air-operated hammer is shown in the hammer head up position and hammer head down position, respectively. FIGS. 2A and 2B show crossectional view's of the hammer through section A-A. In this embodiment, pressurized-air reservoir 2 can also function as a frame for the subject air-operated hammer. The use of tubing for the reservoir, which also functions as the frame, can produce a hammer which is strong, light weight, and durable. Furthermore, by having the reservoir serve as a frame, the hammer can be smaller and, therefore, more maneuverable and versatile. In addition, the frame of the subject hammer, when designed to be an air reservoir, can also function as a water separator, for example a cyclone separator to separate water from the incoming air. For example, the reservoir can be designed such that the incoming air enters on a tangent allowing the air to swirl around the reservoir such that water in the air separates from the air and drops into a section of the reservoir for collection and convenient removal.

It is preferred to have the pressurized air reservoir as close to cylinder 7 as possible. Cylinder 7 can be a chamber wherein piston 5 resides, and is preferably cylindrical in shape. Cylinder 7 can accept pressurized air which raises piston 5 and, therefore, hammer head 12 which is connected to piston 5 via rod 9. In an optimal design the reservoir can accept incoming air continuously and discharge air intermittently, for example during, the up stroke of the hammerhead. The proximity of the air reservoir to the cylinder reduces friction loss and pressure drop due to the travel of the air. In contrast, current air-operated hammers are typically supplied with compressed air via a 50 to 100 foot air hose, resulting in friction losses and a lower air pressure at the output of the hose than at the input.

In a specific embodiment, referring to FIG. 1A, connected to frame 2 is cross-member 4*a* which can act to tie the vertical frame together. In addition, cross-member 4*b* can act as a mounting bracket for cylinder head 10, cylinder 7, and valve assembly 8. Cross-member 4*a* can act to tie the top of frame 2 together and can also act to locate the top of cylinder 7. A vertical stiffener plate, not shown in the Figures, can act to tie cross-members 4*a* and 4*b* together and can also act to tie the right and left sides of frame 2 together. In a specific embodiment, the volume between cross members 4*a* and 4*b* can be enclosed by wall 37 creating a cavity which can be used as a pressurized air reservoir or to augment pressurized air reservoir 2. This cavity can encapsulate cylinder 7. The portion of the tubed framing 2 within this cavity can have apertures which allow air to pass freely between the cavity and the frame tubing thereby forming one large air reservoir including the frame tubing and the cavity.

Figure 5A:
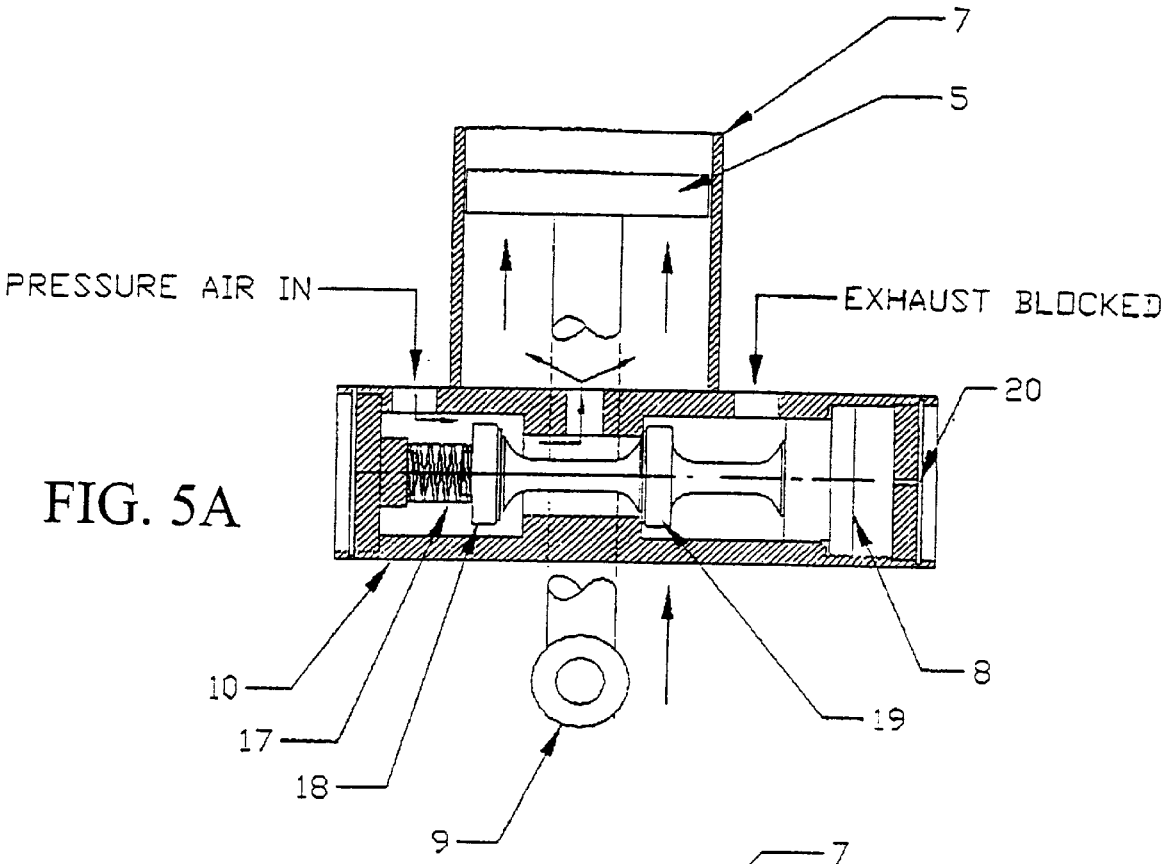
FIGS. 5A and 5B show a specific embodiment of an automatic control valve, in the inlet air open position and inlet air closed position, respectively, in accordance with the subject invention.
Figure 5B:
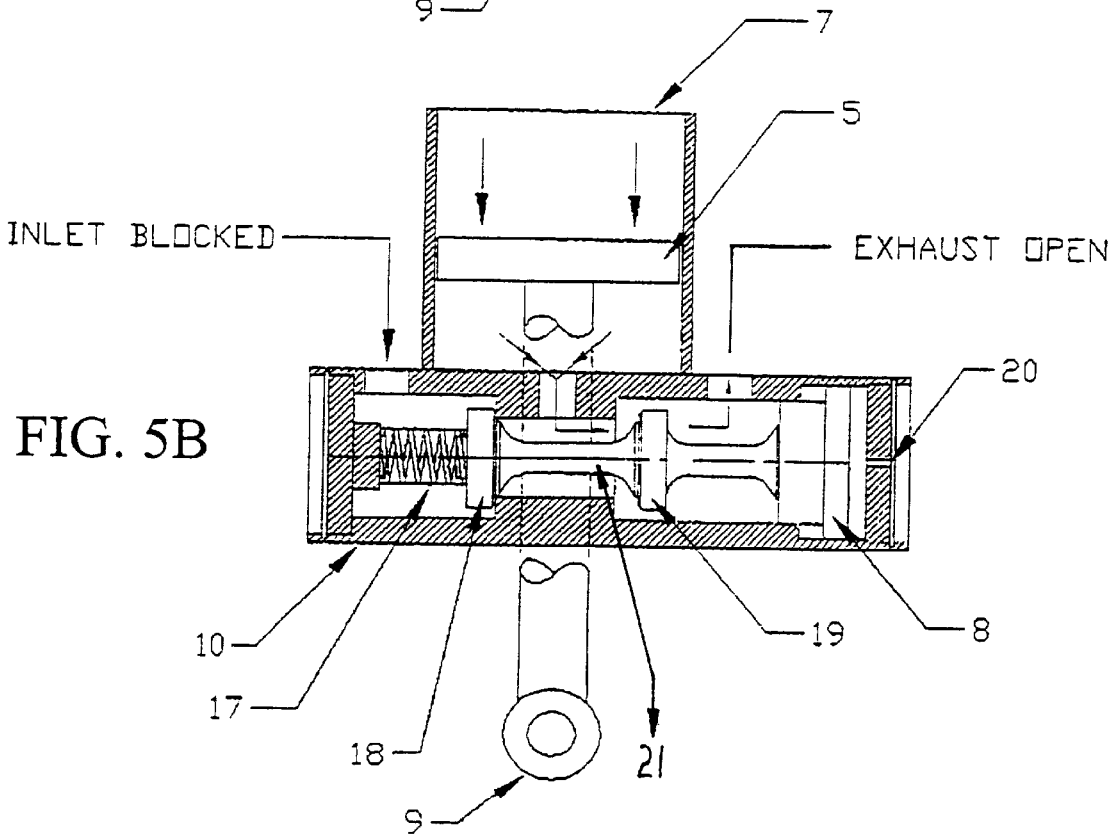

Cylinder head valve 8 can be designed into cylinder head 10 and ported directly to reservoir 2, reducing friction loss from reservoir 2 through cylinder head 10. Cylinder head 10 can house a double action three port air-actuated valve. A variety of valving designs can be implemented with respect to the subject invention. A specific embodiment of a double action three port air-actuated valve 8 is shown in FIGS. 5A and 5B for the inlet air open position and the inlet air closed position, respectively. Preferably, the body of valve 8 can be formed as an integral part of cylinder head 10. In a specific embodiment, the body of valve 8 can house three ports. First, an inlet port can allow pressurized air, for example from an external pressurized air source, to enter and pass through the valve body and enter cylinder 7 when valve 8 is in the inlet air open position. Second, an outlet port can allow air to exit cylinder 7, through valve 8, via the outlet port into the environment when valve 8 is in the inlet air closed position. Finally, a cylinder port 20 which allows pressurized air, for example from control valving, to enter valve 8 in order to push the valve stem over to the inlet air open position.

The valve can be designed with a single stem 21 and two seats 18 and 19 such that when the inlet seat is open, the outlet, or exhaust, seat is closed. Conversely, when the inlet seat is closed, the outlet, or exhaust, seat is open. The valve stem can be air actuated such that pressurized air can enter the cylinder port and push the valve stem over to open the inlet seat and close the outlet seat. When the pressurized air supply is shut off at the cylinder port, spring 17 can push the valve stem back over to close the inlet seat and open the outlet seat.

In a design where the cylinder head acts as the valve body, cylinder head 10 can also attach cylinder 7 to frame 2. Accordingly, cylinder head 10 can perform at least three functions. Preferably, cylinder head 10 connects directly to reservoir 2, allowing large volume of high pressure air to pass directly from reservoir 2, through valve 8, to cylinder 7 with a minimum of pressure loss, and rapid exhaust of cylinder air from cylinder 7, through valve 8, out outlet port to the outside environment, with a minimum of restriction. Valve 8 can also have porting to allow the various pressures to be monitored throughout the hammer cycle. For example, valve 8 can be ported such that the pressure at the bottom of cylinder 7 can be read through an outlet port on valve 8. As discussed above, valve 8 can also be ported, for example port 20, to, operate the low-pressure cycle valve 8.

Hammer head 12 can be designed with a large solid metal, for example steel, contact head. The upper part of the hammer head 12 can be filled, for example with lead, to give a maximum dead blow effect. Each side of hammer head 12 can have insert bushings that assure alignment with the frame throughout the cycle. Advantageously, the entire hammer assembly can be disassembled and reassembled within one hour including hammer head 12, anvil. 16*a*, anvil skirt 16*b*, hammer rod 9, cylinder head 10, and cylinder 7.

In operation, anvil 16*a* can sit over the top of an object, for example a piling, to be struck, where anvil skirt 16*b* guides the piling up under anvil 16*a* and holds the piling in place. In a specific embodiment, anvil 16*a* can move between top and bottom stops 14*a* and 14*b*, respectively. Anvil 16*a* can float up and down on bushings for example providing approximately 3 ½" of travel. Preferably, the entire hammer can be placed over the top of an object to be contacted, for example a piling, with anvil 16*a* on top of the piling such that stop 14*a* top rests on anvil 16*a*. Hammer head 12 is then driven upward by pressurized air entering cylinder 7 and then free-falls to strike anvil 16*a*, driving the piling down. An embodiment which allows anvil 16*a* to float between stops 14*a* and 14*b* can reduce stresses on the frame and various components of the hammer and allow a larger portion of the momentum of the hammer head to be transferred to the object being contacted, rather than to the body of the hammer itself. Accordingly, this reduces wear and tear on the hammer and increases the efficacy of the hammer.

Hammer head 12 can have bushings on either side to guide it as it is pushed up and as it free-falls down, along frame 2. The bottom end of rod 9 can be attached to hammer head 12 by pin 13. The top end of rod 9 can pass through cylinder head 10 and attach to piston 5 located within cylinder 7. When valve 8 opens the air inlet port to let air in from high-pressure reservoir 2 to pass through valve 8 to cylinder 7, the pressurized air drives piston S upward pulling the hammer head 12 toward the top of its cycle. After cycling of valve 8, air from within cylinder 7 can pass through valve 8 and out exhaust port 11, allowing hammer head 12 to free-fall back down to anvil 16*a*, driving the piling. The cycle can then begin again.

Figure 6B:
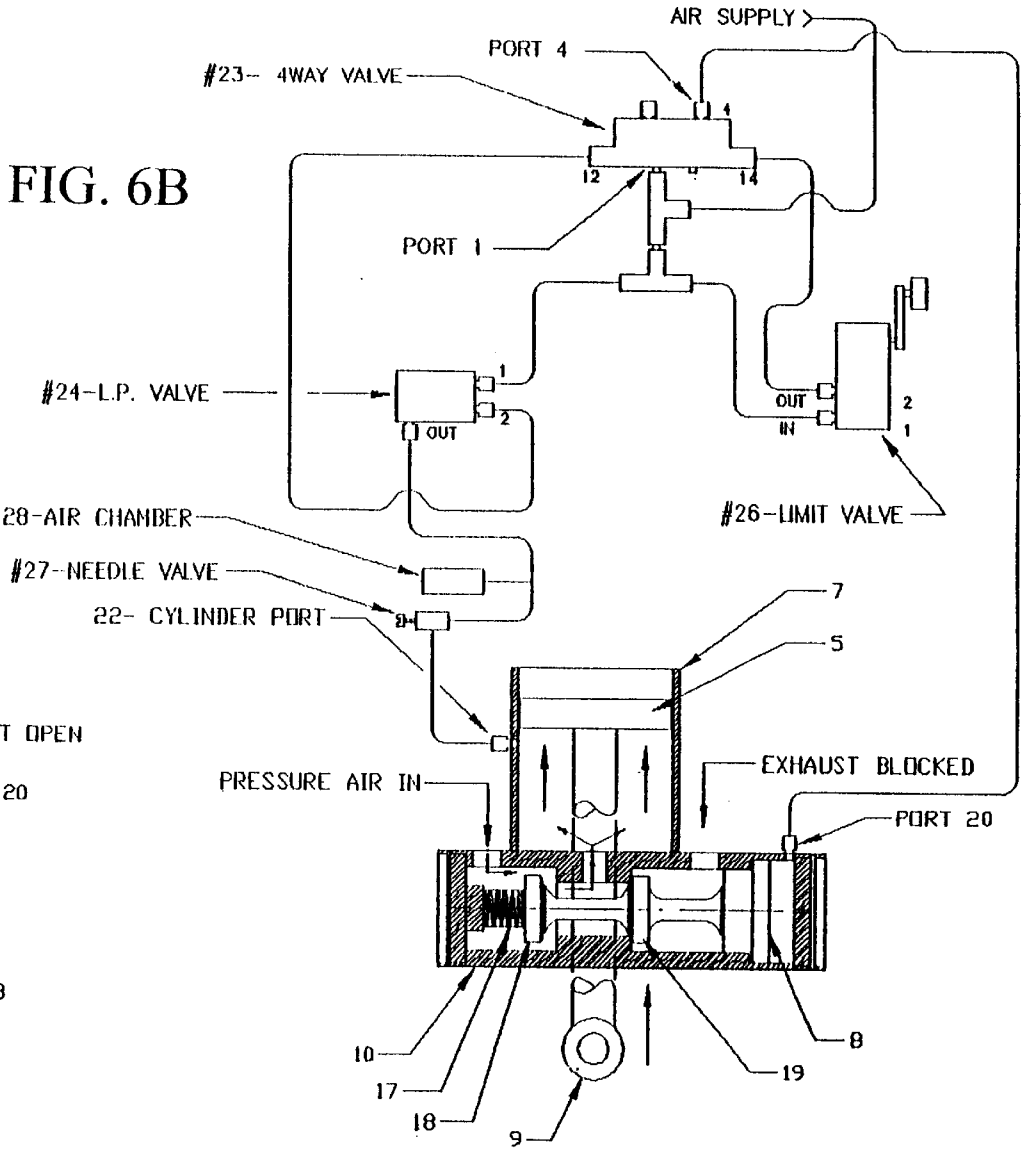
FIG. 6A and 6B show a specific, embodiment of an automatic control valve system in accordance with the subject invention.
Figure 6A:
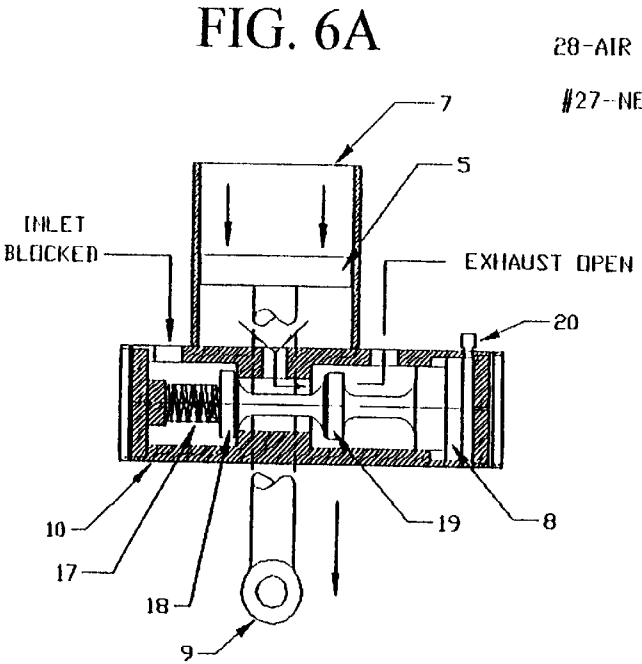
Figure 7:
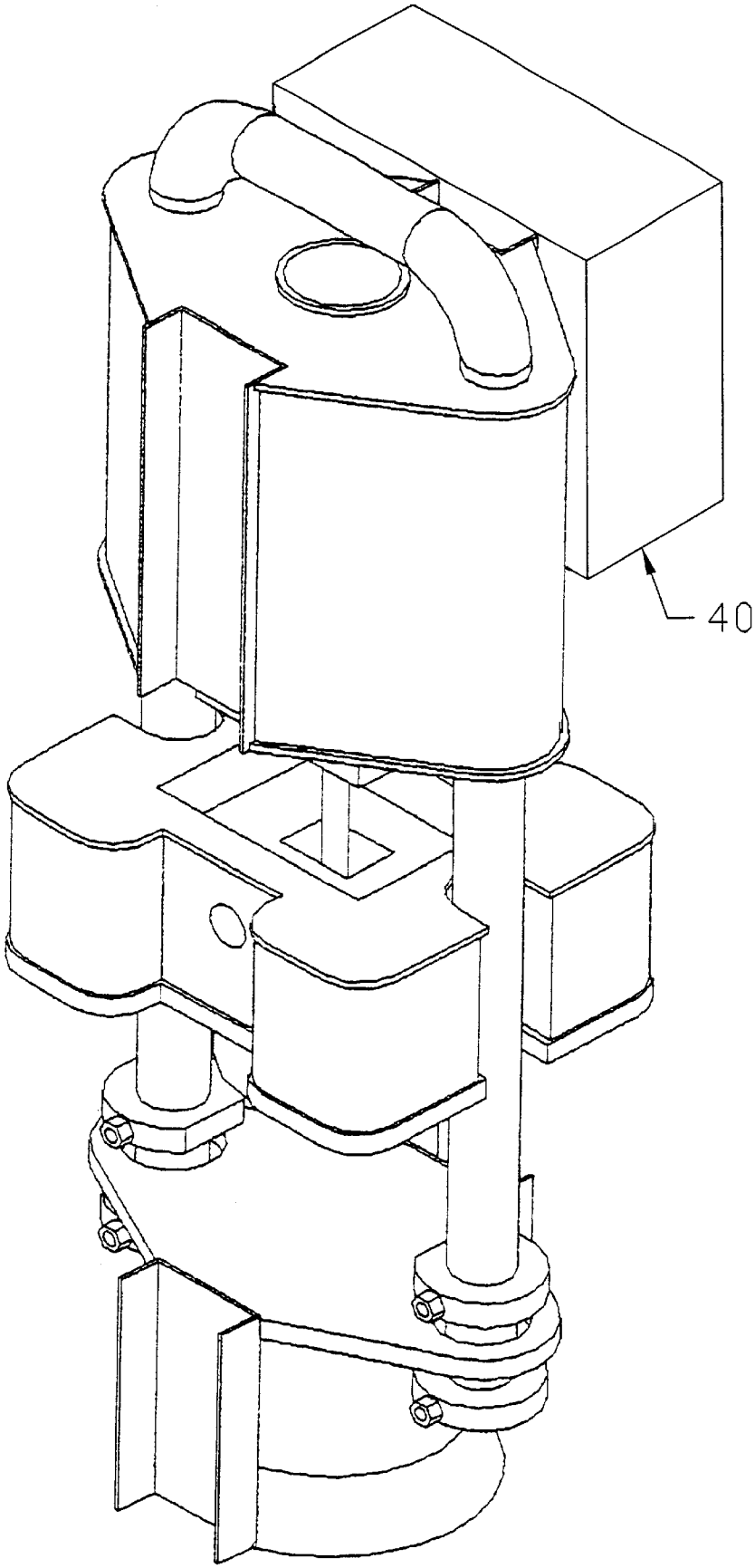
FIG. 7 shows a perspective view of a specific embodiment of the subject invention.

The following is a detailed description of how a specific embodiment of an automatic control valve system can effect the cycling of the hammer through the up and down strokes. With reference to FIG. 6A, valve 18 is closed and valve 19 is open. Whereas in FIG. 6B, valve 18 is open and valve 19 is closed. Preferably, the control valves are operated by high-pressure air. A high-pressure air supply feeds in, as shown in FIG. 6B, and is constantly supplied at port 1 of 4-way valve 23, port 1 of low pressure valve 24, and port 1 of limit valve 26. Starting the description of the control valve system when the hammer is at the bottom of the down stroke, see FIG. 6A, cylinder port 22 outputs the air pressure within cylinder 7 below piston 5 to the control port of low pressure (LP) valve 24. Alternatively, rather than by cylinder port 22, the air pressure of cylinder 7 can be ported through the body of valve 8 and output to valve 24 from an output port on valve 8. In a specific embodiment low-pressure valve 24 is set to open and allow the high pressure air from port 1 to flow to port 2 when a pressure of 3 psi or lower is inputted to the control port of valve 24. Upon the receipt of low pressure at the control part of LP valve 24, LP valve 24 opens between port 1 and port 2 allowing high pressure air from port 1 to be supplied out port 2 to port 12 of 4-way valve 23. Upon receipt of high pressure air at port 12 of valve 23, port 4 of valve 23 opens allowing high pressure (HP) air to travel out port 4 to cylinder head valve port 20. The HP air at cylinder head valve port 20 drives the valve stem over to close exhaust seat 19 and open inlet seat 18. The opening of inlet seat 18 allows air from reservoir 2 to pass through valve 8 and into cylinder 7, rapidly driving piston 5 and hammer head 12 up.

In a preferred embodiment, a needle valve 27 with an air chamber 28 is inserted in the valve system between cylinder port 22 and low-pressure valve 24. The purpose for inserting needle valve 27 with air chamber 28 is to allow the hammer head to travel all the way, or near, to the bottom of the stroke and have the desired dwell time, before allowing air to enter cylinder 7 to raise the hammer head for the up stroke. The amount of dwell time before the cycle starts again can be adjusted by adjusting needle valve 27. For example, by adjusting needle valve 27 inward, the dwell time gets longer resulting in less cycles per minute. Likewise, by adjusting needle valve 27 out the dwell time gets shorter, allowing more cycles per minute. By placing air chamber 28 between needle valve 27 and low-pressure valve 24 and adjusting needle valve 27, air chamber 28 bleeds off at a desired slower, rate. This reduced rate of pressure drop of air chamber 28 reduces the rate of pressure drop at the control port of low pressure valve 24 such as to delay the opening of port 1 to port 2 of valve 24. Accordingly, needle valve 27 can be used as a timer to adjust the dwell time and, therefore, the cycles per minute. When cylinder 7 is pressurized and the up stroke begins, cylinder port 22 allows the high pressure air to pressurize air chamber 28 and low pressure valve 24 through needle valve 27.

In a specific embodiment, the adjustment of the dwell time can be utilized to time the up stroke of the hammer head to the rebound of the object, for example piling, being driven. When a piling is struck on the top by the hammer head the piling is driven down into the ground. However, due to the elastic nature of the ground, the piling often rebounds back up and jars the hammer head. If the initiation of the up stroke is timed to begin just as the rebounding piling strokes the hammer head, some of the momentum from the rebounding piling can be transferred to the hammer head on the way up. In a typical situation, the time delay between the initial contact of the piling and the rebound contact is on the order of four milliseconds. Accordingly, the dwell can be adjusted to time the beginning of the up stroke with this rebound to enhance the efficiency of the hammer.

The use of an air operated control valve system offers superior performance compared to a mechanically controlled hammer. Mechanically controlled hammers often triggers air to enter the cylinder before the hammer head reaches the bottom of the stroke, reducing the momentum of the hammer head before contact. This reduction in momentum of the hammer head reduces the momentum transfer to the contacted object and, therefore, reduces the efficacy of the hammer.

After air is allowed to enter cylinder 7, piston 5 continues to travel up. In a specific embodiment, a limit valve 26 is utilized to detect when piston 5 reaches a certain point in the up stroke. Piston 5 continues to travel up, eventually striking the wheel on limit valve 26 part way up the hammer stroke. Limit valve 26 can be placed on an adjustable bar such that the point in the up stroke at which piston 5 strikes limit valve 26 can be adjusted. The striking of the wheel on limit valve 26 allows HP air to pass from port 1 to port 2 of limit valve 26. The HP through port 2 enters port 14 of 4-way valve 23, closing port 4 of valve 23. The closing of port 4 removes the HP air from port 20 of the cylinder head valve 8, such that spring 17 pushes inlet seat 18 closed and exhaust seat 19 open. Accordingly, no further air passes from reservoir 2 to cylinder 7 and air actually begins to exhaust from cylinder 7 through exhaust port of cylinder head valve 8.

After striking the wheel on limit valve 26, the momentum of the hammer carries it to the top of cylinder 7 where the hammer then free-falls back down to the bottom, starting the cycle all over again.

Figure 8:
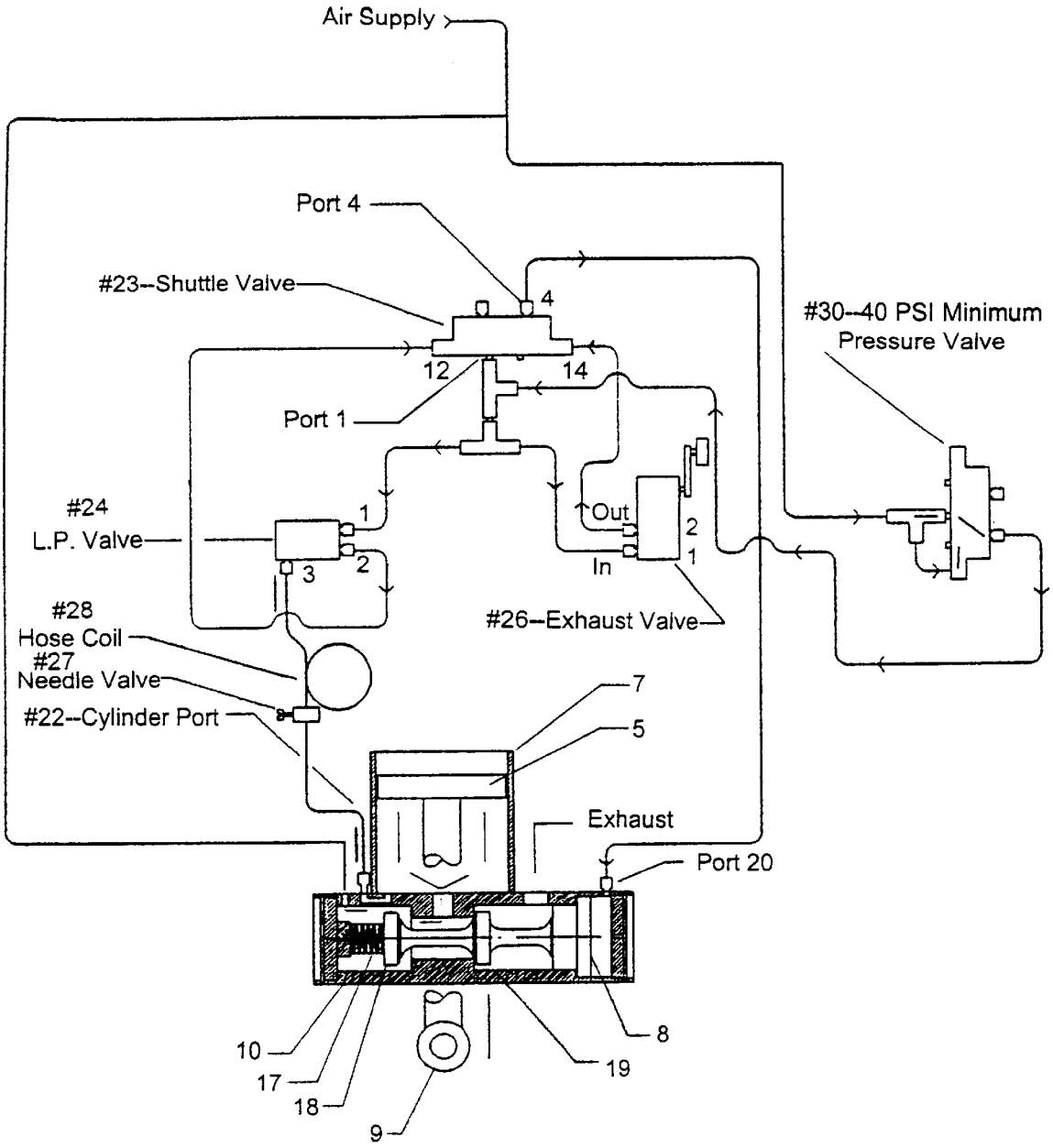
FIG. 8 shows a specific embodiment of an automatic control valve system in accordance with the subject invention.

Referring to FIG. 8, a specific embodiment of an automatic control valve system in accordance with the subject invention is shown. This automatic control valve system is similar to the system shown in FIG. 6B and operates in basically the same way. Inserted between high-pressure air supply and each of 4-way valve 23, port 1 of low pressure valve 24, and port 1 of limit valve 26, is a minimum pressure valve 30. In the embodiment shown in FIG. 8, minimum pressure valve 30 is set for a minimum pressure of 40 psi, such that when 40 psi is achieved, valve 30 opens allowing pressurized air to flow to 4-way valve 23, port 1 of low pressure valve 24, and port 1 of limit valve 26. When the hammer head is at rest and there is essentially no pressure in cylinder 7, valve 24 is open such that air can flow through to port 12 of valve 23 causing port 4 of valve 23 to open such that air flows into port 20. Pressurized air flowing into port 20 causes valve 18 to open, injecting high pressure air into cylinder 7 which accelerates the hammer head upwards. The upward moving hammer head triggers exhaust valve 26, for example by striking the trigger mechanism of valve 26, which directs pressurized air to port 14 of valve 23. Pressurization of port 14 of valve 23 shuts off and bleeds down port.4 of valve 23, causing the hammer head to fall under gravity. When low pressure valve 24 senses the threshold pressure, for example 3 psi or less, port 2 of valve 24 opens to shuttle port 12 of valve 23.

Still referring to the embodiment shown in FIG. 8, to keep low-pressure valve 24 from sensing 3 psi prematurely, causing excessive blows per minute, needle valve 27 and hose coil 28 can be placed between cylinder port 22 and low-pressure valve 24. Note that cylinder port 22 enters cylinder head 10 and is channeled into cylinder 7, for the embodiment shown in FIG. 8. When cylinder 7 is pressurized and the upstroke of the hammer head occurs, cylinder port 22 pressurizes hose coil 28 and low-pressure valve 24 through needle valve 27. When the exhaust stroke occurs, needle valve 27 functions to cause the air pressure from hose coil 28 and low-pressure valve 24 to bleed off at a desired rate, preferably slowly, such that pressure is maintained even after cylinder 7 has no pressure.

During the operation of the embodiment shown in FIG. 8, the pressurized air supply, for example, an air compressor, should preferably maintain a pressurized air pressure of at least 110 psi. This helps to ensure proper operation of the valving system. As an example, a 185 cfm compressor can be set at 120 psi to hold a steady 110 psi during operation. Preferably, the pressurized supply is delivered by a 1" diameter hose no longer than 100' long. A gate valve, rather than a ball valve, is preferably used between the compressor and oiler to control the flow. Ball valves can be hard to adjust and preferably are used only to start and stop hammer operation. Once the gate valve is set for a particular air compressor, re-adjustment is typically necessary. To increase the number of blows per minute, needle valve 27 can be opened, i.e., turned counterclockwise. To decrease the number of blows per minute, needle valve 27 can be closed, i.e., turned clockwise. To increase the length, or height, of the stroke, exhaust valve 26 can be moved up. To reduce stroke height, exhaust valve 26 can be lowered. Small adjustments at a time are preferred for both valve adjustments. The stroke height and number of blows per minute can be difficult to maintain at a constant stroke height and speed when the gate valve delivers too much air to hammer. Accordingly, the valve can be gradually closed to reduce flow. After about 5 to 8 blows, further adjustments can be made. If the hammer hits several blows at the same rate and then misses or slows a few beats, gate valve can be opened a little at a time in order to increase the flow. Readjustment of the stroke height (exhaust valve 26) and the number of blows per minute (needle valve 27) may have to be made several times for optimum performance. In a specific embodiment, full stroke at 53 to 60 blows per minute is ideal.

In a specific embodiment, the pipe frame of the hammer can serve as a pressurized air reservoir. With respect to this embodiment, air can be bled off and water and/or dirt in the pipe frame can be disposed of by opening petcocks on the pipe frame. Other gases can be used to supply the pressurized gases needed for the subject invention.

In a specific embodiment, the subject air-operated hammer can be designed to utilize interchangeable heads for different tasks, including pile hammering, demolition, forging, and compacting. For example, for demolition the hammer can have a wedge head for breaking concrete and for compacting the hammer can have a large surface flat plate. These heads can be interchanged depending on the use.

In a further embodiment of the subject invention, a two stroke hammer can be implemented where pressurized air can be allowed to enter cylinder 7 on top of piston 5 during the down stroke of the hammer head. The use of pressurized air on the down stroke in this way can increase the momentum of the hammer head and therefore increase the impact of each hammer stroke. A second valve similar to valve 8 can be utilized to control the flow of pressurized air into and out of cylinder 7 above piston 5. Additional control valving can then be used to coordinate the two valves to optimize the timing of the two strokes of the hammer. Reservoir 2 can supply air for both strokes or a second separate reservoir can be utilized for the down stroke.

In a specific embodiment of the subject invention, an acceleration detector can be utilized to measure the deacceleration of the hammer head upon striking an object. This detector can be used, for instance if the hammer is being used to drive pilings and each piling is supposed to be driven in to a particular equivalent inertia. Accordingly, when a certain deacceleration of the hammer head is achieved upon impact, the operator can stop.

Referring to FIGS. 1A and 2A, and considering an embodiment of the subject hammer having the volume between cross members 4*a* and 4*b* enclosed by wall 37 creating a cavity which is used as a pressurized air reservoir to augment pressurized air reservoir 2, it is advantageous for the volume of pressurized air reservoir 2 to be larger than the volume of cylinder 7. Preferably, the volume of pressurized air reservoir 2 is at least twice as large as the volume of cylinder 7, more preferably at least three times as large, and even more preferably at least four times as large. Having a large volume reservoir 2 relative to the volume of cylinder 7, allows reservoir 2 to supply air to cylinder 7 at a high rate and can allow air to be supplied at a much higher rate than the compressed air supply can provide.

Figure 9:
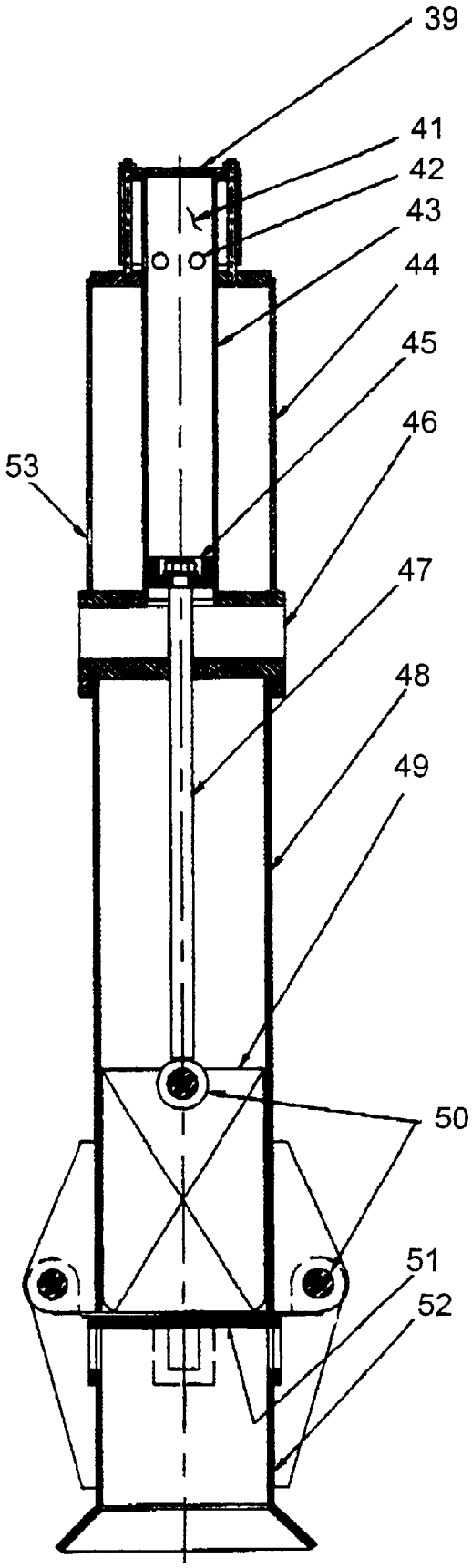
FIG. 9 shows a specific embodiment of an air-operated hammer which incorporates a bounce chamber and shock bushings in accordance with the subject invention.

Referring to FIG. 9, an embodiment of the subject invention which incorporates bounce chamber 41 and shock bushings 50 is shown. For clarity and ease of discussion the following are also: referenced: cylinder head 39, air exhaust apertures 42, cylinder 43, reservoir 44, piston 45, valve 46, rod 47, hammer housing 48, hammer 49, floating plate 51, bell assembly 52, and input aperture 53.

As piston 45 starts the up-stroke of the hammer, air in cylinder 43 above piston 45 is compressed by piston 45 and exits air exhaust apertures 42. However, once piston 45 passes apertures 42 the air remaining in cylinder 43 can not exit apertures 42. The portion of cylinder 43 above apertures 42 is referred to as a bounce chamber 41. Bounce chamber 41 can allow the trapping of air as piston 45 is raised past air exhaust apertures 42. As this trapped air is further compressed, it exerts a force on piston 45 which tends to slow the upward motion of piston 45 and, therefore, hammer 49. The compressed air in bounce chamber 41 also pushes up on cylinder head 39 so as to support a portion of the weight of the entire hammer apparatus.

In a specific embodiment, the size of bounce chamber 41 can be selected with respect to the other parameters of the hammer apparatus, so that the air compressed in the bounce chamber 41 actually lifts the entire hammer apparatus. In this way, the weight of the hammer apparatus can assist the next hammer blow. As the lifted hammer apparatus starts to fall, the top of bounce chamber 41 pushes on the air in the bounce chamber so that the air compressed in the bounce chamber 41 can push the top of the piston down to initiate the down stroke of the hammer so as to contribute to the downward momentum of the hammer. In this way, the air compressed in the bounce chamber can act as sort of a spring. In addition, the size of bounce chamber 41 can be dependent on the location where the hammer is used. For example, the size for a hammer to be used in Florida, near sea level, might be different than for a hammer to be used in Colorado, well above sea level.

Referring again to FIG. 9, shock bushings 50 are shown which can be incorporated with the subject hammer to, for example, reduce wear and tear. In the embodiment shown in FIG. 9, two lower shock bushings are shown. If desired, four, or more, such bushings 50 can reside near the bottom of hammer housing 48. Without these bushings when floating plate 51 is raised above, for example, a pile, and hammer 49 hits floating plate 51, floating plate 51 can reach the bottom of bell assembly 52 and cause bell assembly 52 to contact housing 48. Without bushings 50, the contacting of housing 48 by bell assembly 52 in this situation can cause damage to the housing 48, such as cracking. The hitting of bell assembly 52 by floating plate 51 can result because floating plate 51 floats within slots in bell assembly to keep floating plate properly 51 positioned. These bushings 50 can reduce damage to the housing by coupling the lower portion of hammer housing 48 and bell assembly 52 so as to provide some give to allow, housing 48 and bell assembly 52 to approach each other when hammer 49 hits floating plate 51 and floating plate 51 hits, for example, a pile.

In an alternative embodiment, floating plate 51 can be extended out to attach to shock bushings 50. This embodiment can be useful for busting concrete, where a pin attached to hammer 49 travels through an aperture in floating plate 51 to contact the concrete. Accordingly, shock bushings 50 can couple the lower portion of hammer housing 48 to floating plate 51 so as to allow some given when hammer 49 hits floating plate 51. The use of the lower shock bushings 50 can thus save wear and tear on the lower portion of hammer housing 48 and the entire hammer apparatus.

The top shock bushing shown in FIG. 9 can couple the lower end of rod 47 to hammer 49 in order to provide give between rod 47 and hammer 49 when hammer 49 hits floating plate 51. Again, this shock bushing reduces wear and tear of the hammer apparatus.

In a specific embodiment of the subject invention the air input to the chamber to raise the piston and the control of the air exhausting from the chamber can be separately controlled. For example, two valves controlled by two corresponding solenoids can be used. In this way, a first valve can open to allow air to flow into the chamber to raise the piston. Once enough air has entered the chamber to raise the piston the desired height or provide the desired momentum, the first valve can be closed. The compressed air in the chamber can then continue to expand and continue to raise the piston while the valve controlling the exhaust is still closed, if desired. Once the piston has reached a point where opening the exhaust valve will not adversely affect the operation of the hammer apparatus, the exhaust valve can be opened. In a specific embodiment, referring to the hammer apparatus shown in FIG. 9, the exhaust valve can be opened when the bounce chamber 41 reaches a desired pressure. This would be efficient in the sense that the exhaust valve is closed when air is entering from the reservoir into the chamber and while the air in the chamber is expanding after closing the air input valve, and the exhaust valve is opened once the piston is about to start, is starting, or has just started, the downward stroke, as desired.

The exhaust valve can remain open allowing air to exit the chamber while the piston is traveling down. The air input valve can stay closed during the down stroke of the piston as well. Once the piston is nearing floating plate to input energy to the desired target, is hitting the floating plate, or has just hit the floating plate, the exhaust valve can be closed. Once the exhaust valve is closed, or simultaneously with closing the exhaust valve, the air input valve can then be opened to start a new stroke. Of course, by adjusting the amount of time the air input valve is open, the pressure in the bounce chamber which triggers the openings of the exhaust valve (note the opening of the exhaust valve can be triggered by other means such as a switch trigger at a certain height of the piston), and the delay between the piston striking the floating plate and the opening of the air input valve, a variety of parameters with respect to the subject hammer can be controlled. These include the length of the stroke (and therefore the force of the blow), the assistance provided by the bounce chamber, and the number of strokes per time. As mentioned, the triggering of the opening and closing of the air input valve and exhaust valve can be based on a variety of input, such as a period of time after another event, pressures in different portions of the chamber, and the height and direction of the piston.

Figure 10:
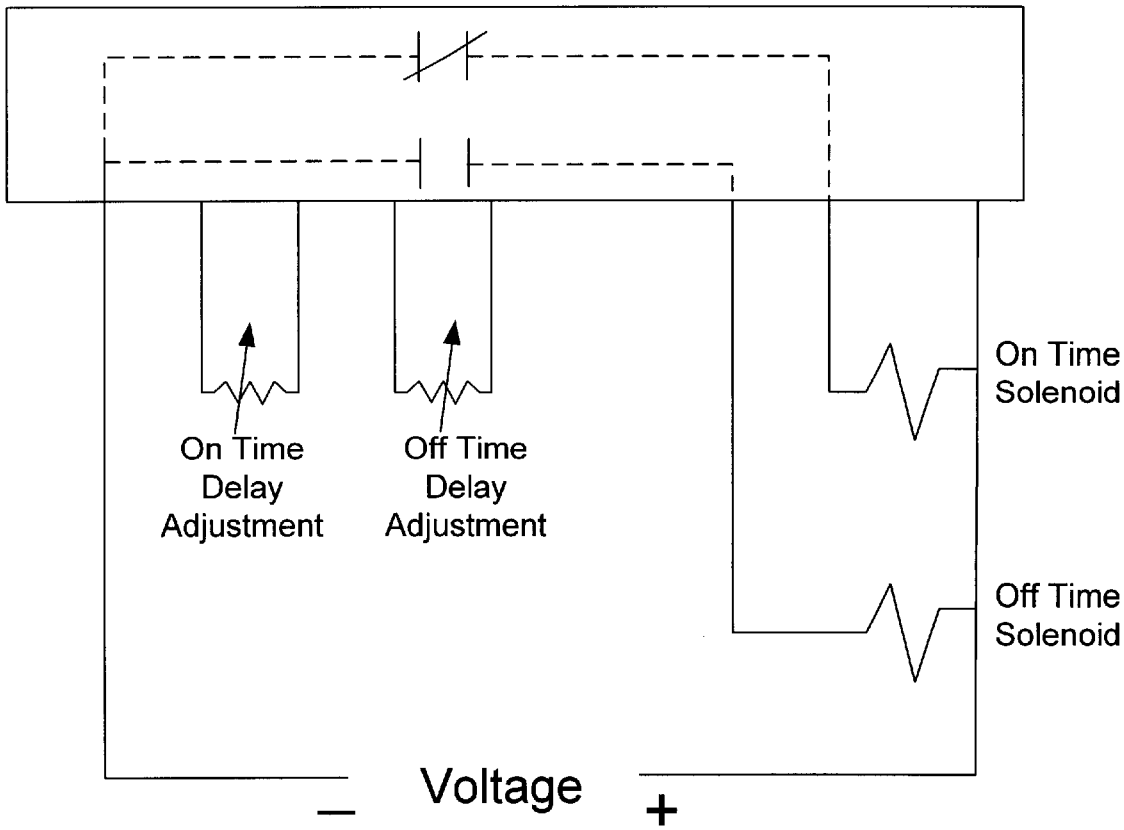
FIG. 10 shows a specific embodiment of a digital time delay module which can be utilized with the subject invention.

The subject hammer can utilize electrical power, for example from 12, 24, and/or 28 volts DC and/or 24, 120, and/or 230 volts AC, to operate solenoids which control the valve controlling the air into the chamber and/or the air exhausting from the chamber. FIG. 10 shows a digital time delay module which can be utilized with the subject invention. By adjusting the time delay module and the solenoid coils, a desired voltage can be achieved. The operator can manually control the air control solenoids by adjusting the time delay module, in order to change the number of strokes per minute. Such adjustments can be made by varying the up and down external time delay adjustments in the time delay module. The length of the stroke can be changed by adjusting the amount of air allowed to enter the chamber. The length of the stroke can determine the force of the blow struck by the piston.

This device can be used to break-up concrete roadways. In a specific embodiment, several individual hammer apparatus can be used as one unit and controlled by, for example a computer, to achieve sequential vibration free striking, similar to the timing and firing of a piston engine. The operator, through the computer program, may control the length and timing of the striking sequence in each device in the unit in order to maximize the effectiveness of each strike and reduce wear and tear on the equipment.

It is preferable for the reservoir to be large enough in relation to the chamber to throw the piston up to the desired height of the stroke. Also, it is desirable for the reservoir to be able to sustain its pressure while pushing the piston up. It is desirable for the reservoir to be able to provide air to throw the piston up and then refill during the rest of the up stroke and the down stroke of the piston. In addition, as with the embodiment shown in FIG. 9, it is desirable for the reservoir to be able to throw the piston up such that a portion of the pistons upward momentum can be stored as compressed air in the bounce chamber 30 as to help assist the piston at the initiation of the down stroke. Accordingly, it is preferable for the reservoir to be at least 2–3 times as large, and even more preferably at least 4–5 times as large. Preferably, the reservoir can supply the air input needs without reliance on the compressed air coming from the compressed air source, although the reservoir can continue to receive air during the time the air input valve is open. Preferably, a sufficient amount of air to raise the piston to the desired height can be inputted into the chamber during less than 50% of the height of the piston stroke, more preferably less than 30% of the height of the piston stroke, and even more preferably less than 15% of the height of the piston stroke.

The size of the compressed air source can be selected, based on the parameters of the hammer apparatus, such that the compressed air source can replenish the reservoir with the amount of air used during the time the air input valve is open, during the length of time of the stroke. Of course, an appropriate amount of extra capacity can be factored in.

All patents, patent applications, provisional applications, and publications referred to or cited herein are incorporated by reference in their entirety to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. An air-operated hammer, comprising a hammer head;

a frame;

an air flow control valve;

a pressurized air reservoir, wherein lifting of the hammer head is assisted by pressurized air from the pressurized air reservoir and wherein said pressurized air reservoir receives pressurized air from a pressurized air source during at least a portion of the period of time the hammer head is dropping; and a piston housed in a cylinder, wherein pressurized air entering a bottom portion of the cylinder causes the piston to raise the hammer head, wherein the volume of the pressurized air reservoir is larger than the volume of thy cylinder.

2. The air-operated hammer, according to claim 1, wherein said pressurized air source is, an external pressurized air source connected to the hammer via a high pressure air hose.

3. The air-operated hammer, according to claim 1, wherein said pressurized air source is attached to the air-operated hammer.

4. The air-operated hammer according to claim 3, wherein said pressurized air reservoir is located near a pressurized air inlet of the air flow control valve.

5. The air-operated hammer according to claim 1, wherein said frame houses said pressurized air reservoir.

6. The air-operated hammer according to claim 1, wherein said frame comprises tubing, wherein said tubing forms at least as portion of said pressurized air reservoir.

7. The air-operated hammer according to claim 1, wherein said air flow control valve comprises an inlet valve for allowing pressurized air to enter the bottom portion of the cylinder and assist in raising the hammer head, and an exhaust valve for allowing air to exit the bottom portion of the cylinder.

8. The air-operated hammer according to claim 7, wherein a valve comprising two seats functions as both the inlet valve and the exhaust valve, such that in a first position, the inlet valve is open and the exhaust valve is closed, and in a second position, the inlet valve is closed and the exhaust valve is open.

9. The air-operated hammer according to claim 8, further comprising a means for actuating the air flow control valve from the first position to the second position and from the second position to the first position.

10. The air-operated hammer according to claim 9, wherein said means for actuating the air flow control valve between the first and second positions comprises at least one valve actuation inlet port, wherein said valve actuation inlet port can allow pressurized air to enter the air flow control valve and move said valve stem.

11. The air-operated hammer according to claim 10, wherein said means for actuating the air flow control valve between the first and second positions further comprises at least one spring, wherein the spring maintains said stem in one of said first and second positions until pressurized air is allowed to enter one of said at least one valve actuation inlet port to move said stem into the other position.

12. The air-operated hammer according to claim 9, wherein said means for actuating the air flow control valve between the first position and second positions comprises at least one spring.

13. The air-operated hammer according to claim 9, wherein said means for actuating the air flow control valve from the first position to the second position and from the second position to the first position is an automatic control valve system fed by pressurized air.

14. The air-operated hammer according to claim 13, further comprising a minimum pressure valve coupled between an air supply and the automatic control valve system, wherein pressurized air is supplied to said automatic control valve system only when the air supply reaches a minimum operating pressure.

15. The air-operated hammer according to claim 1, further comprising a low pressure valve, wherein when the air pressure in bottom portion of the cylinder drops below a certain minimum level said low pressure valve causes pressurized air to enter the bottom portion of the cylinder, raising the hammer head.

16. The air-operated hammer according to claim 15, further comprising a means coupled between the air in the cylinder and the low pressure valve which allows the control of dwell time.

17. The air-operated hammer according to claim 16, wherein said dwell time can be adjusted to time the entry of the pressurized air into the lower portion of the cylinder to begin as an object being hammered rebounds up and contacts the hammer head.

18. The air-operated hammer according to claim 1, further comprising a limit valve, wherein when the piston climbs above a certain position in the cylinder said limit valve causes the pressurized air entering the bottom portion of the cylinder to stop, and causes the air in the bottom portion of the cylinder to be allowed to exhaust.

19. The air-operated hammer according to claim 18, wherein the certain position in the cylinder is adjustable.

20. The air-operated hammer according to claim 1, wherein air enters the bottom portion of the cylinder from said pressurized air reservoir at a faster rate than the pressurized air source can supply.

21. The air-operated hammer according to claim 1, further comprising an anvil, wherein said anvil holds an object to be hammered in place.

22. The air-operated hammer according to claim 21, wherein said anvil floats between a first stop and a second stop.

23. The air-operated hammer according to claim 1, wherein said hammer is operated by a fluid selected from the group consisting of: steam and gas.

24. The air-operated hammer according to claim 1, wherein said hammer head is designed for a function selected from the group consisting of: pilehammering, concrete breaking, forging, compacting, and demolitioning.

25. The air-operated hammer according to claim 1, wherein lowering of the hammer head is assisted by pressurized air.

26. The air-operated hammer according to claim 1, wherein the volume of the pressurized air reservoir is at least twice as large as the volume of the cylinder.

27. The air-operated hammer according to claim 1, wherein the volume of the pressurized air reservoir is at least three times as large as the volume of the cylinder.

28. The air operated hammer according to claim 1, wherein the volume of the pressurized air reservoir is at least four times as large as the volume of the cylinder.

29. The air-operated hammer according to claim 1, further comprising:

at least one exhaust aperture which allows air to exhaust from the cylinder, wherein as the piston is raised the piston compresses air in the cylinder above the piston such that at least a portion of the air in the cylinder above the piston exhausts out of the cylinder through the at least one exhaust aperture; and a bounce chamber wherein the bounce chamber is a portion of the cylinder above the at least one exhaust aperture such that once the piston passes above the at least one exhaust aperture the air remaining in the cylinder cannot exhaust through the at least one exhaust aperture, wherein as the piston is further raised passed the at least one exhaust aperture the air within the bounce chamber is further compressed and exerts a force which tends to slow the upward motion of the piston.

30. The air-operated hammer according to claim 29, wherein the compressed air in the bounce chamber pushes up on the head of the cylinder so as to support at least a portion of the weight of the air-operated hammer.

31. The air-operated hammer according to claim 1, further comprising:

a housing, wherein the hammer head is guided by the housing when falling;

a floating plate, wherein the hammer head hits the floating plate as the hammer head falls; and at least one shock bushing coupling the floating plate to a lower portion of the housing, wherein the at least one shock bushing allows give between the housing and the floating plate when the hammer head hits the floating plate.

32. The air-operated hammer according to claim 1, further comprising:

a floating plate, wherein the hammer head hits the floating plate as the hammer head falls;

a rod connecting the piston to the hammer head; and a shock bushing coupling the rod to the hammer head, wherein the shock bushing allows give between the rod and the hammer head Then the hammer head hits the floating plate.

33. The air-operated hammer according to claim 1, further comprising:

a means for controlling the inputting of air into the cylinder to raise the piston; and a means for controlling the exhausting of air from the cylinder.

34. The air-operated hammer according to claim 33, wherein the means for controlling the inputting of air comprises a first solenoid, wherein the means for controlling the exhausting of air comprises a second solenoid.

35. The air-operated hammer according to claim 34, further comprises:

a time delay module, wherein adjustment of the time delay module adjusts the number of strokes per time.

36. The air-operated hammer according to claim 1, wherein the volume of the pressurized air reservoir is large enough in relation to the volume of the cylinder such that air from the pressurized air reservoir can throw the piston to a desired height of the stroke.

37. The air-operated hammer according to claim 1, wherein an amount of pressurized air from the pressurized air reservoir is inputted to the cylinder to raise the piston to the desired height before the piston reaches 50% of the desired height.

38. The air-operated hammer according to claim 1, wherein an amount of pressurized air from the pressurized air reservoir is inputted to the cylinder to raise the piston to the desired height before the piston reaches 30% of the desired height.

39. The air-operated hammer according to claim 1, wherein an amount of pressurized air from the pressurized air reservoir is inputted to the cylinder to raise the piston to the desired height before the piston reaches 15% of the desired height.

40. An air-operated hammer, comprising a hammer head;

a frame;

an air flow control valve;

a pressurized air reservoir, wherein lifting of the hammer head is assisted by pressurized air from the pressurized air reservoir and wherein said pressurized air reservoir receives pressurized air from a pressurized air source during at least a portion of the period of time the hammer head is dropping, wherein said air flow control valve comprises an inlet valve for allowing pressurized air to enter the bottom portion of the cylinder and assist in raising the hammer head, and an exhaust valve for allowing air to exit the bottom portion of the cylinder, wherein a valve comprising two seats functions as both the inlet valve and the exhaust valve, such that in a first position, the inlet valve is open and the exhaust valve is closed, and in a second position, the inlet valve is closed and the exhaust valve is open;

a means for actuating the air flow control valve from the first position to the second position and from the second position to the first position, wherein said means for actuating the air flow control valve from the first position to the second position and from the second position to the first position is an automatic control valve system fed by pressurized air; and a minimum pressure valve coupled between an air supply and the automatic control valve system, wherein pressurized air is supplied to said automatic control valve system only when the air supply; reaches a minimum operating pressure.

* * * * *